US005240516A

United States Patent [19]

Iseda et al.

[11] Patent Number: 5,240,516

[45] Date of Patent: Aug. 31, 1993

[54] HIGH-CHROMIUM FERRITIC, HEAT-RESISTANT STEEL HAVING IMPROVED RESISTANCE TO COPPER CHECKING

[75] Inventors: Atsuro Iseda, Kobe; Yoshiatsu Sawaragi, Nishinomiya; Fujimitsu Mausyama, Nagasaki; Tomomitsu Yokoyama, Tokyo, all of Japan

[73] Assignees: Sumitomo Metal Industries, Ltd., Osaka; Mitsubishi Jukogyo Kabushiki Kaisya, Tokyo, both of Japan

[21] Appl. No.: 892,126

[22] Filed: Jun. 2, 1992

[30] Foreign Application Priority Data

Jun. 3, 1991 [JP] Japan ..... 3-131167

[51] Int. Cl.[5] ..... C22C 38/20

[52] U.S. Cl. ..... 148/325; 420/61

[58] Field of Search ..... 148/32 S; 420/61, 40

[56] References Cited

FOREIGN PATENT DOCUMENTS 0384317 8/1990 European Pat. Off. .

*Primary Examiner*—Deborah Yee

*Attorney, Agent, or Firm*—Burns, Doane, Swecker & Mathis

[57] ABSTRACT

A Cu-containing, high-Cr ferritic, heat-resistant steel is prevented from copper checking without a reduction in strength, toughness, resistance to hot corrosion, or oxidation, and its weldability is maintained at satisfactory levels. The steel consists essentially, on a weight basis, of: C: 0.03–0.15%, Si: at most 0.7%, Mn: 0.1–1.5%, Ni: 0.05–1.0%, Cr: 8–14%, W: 0.8–3.5%, V: 0.1–0.3%, Nb: 0.01–0.2%, N: 0.001–0.1%, Al: at most 0.05%, Cu: 0.4–3.5%, B: 0–0.02%, one or more elements selected from the group consisting of La, Ce, Ca, Y, Ti, Zr, and Ta: 0–0.2% each, and a balance of Fe and incidental impurities, wherein the Cu and Ni contents satisfy the following Inequality: $2.5 \leqq (\%Cu)/(\%Ni) \leqq 4.5$.

38 Claims, 1 Drawing Sheet

HIGH-CHROMIUM FERRITIC, HEAT-RESISTANT STEEL HAVING IMPROVED RESISTANCE TO COPPER CHECKING

BACKGROUND OF THE INVENTION

The present invention relates to a high-Cr ferritic, heat-resistant steel which contains Cu and which has improved resistance to copper checking in addition to good high-temperature strength and toughness. More particularly, it relates to such a ferritic steel which is substantially free from copper checking during hot working and which is suitable for use in various high-temperature parts required to withstand both high temperatures and high pressures such as steel tubing and piping, steel sheet for pressure vessels, and materials for turbines in a wide variety of industrial applications such as boilers, chemical plants, and nuclear facilities.

Heat-resistant steels for use in heat- and pressure-resistant high-temperature parts for boilers, chemical plants, nuclear facilities, or the like must have excellent high-temperature strength, resistance to hot corrosion and oxidation, and toughness, yet they must exhibit good workability and weldability, and it is also desirable that they be economical.

Conventional steels for use in such applications include (1) austenitic stainless steels such as ASTM TP 321H and TP 347H, (2) low-alloy steels such as 2¼Cr-1Mo steel, and (3) high-Cr ferritic steels containing 9–12% Cr by weight. High-Cr ferritic steels are advantageous in that they are superior to low-alloy steels in respect to strength and resistance to hot corrosion and oxidation at temperatures in the range of 500°–650° C. while they are free from stress corrosion cracking, which is unavoidable in austenitic stainless steels. Furthermore, compared to austenitic stainless steels, high-Cr ferritic steels are less expensive and have a higher thermal conductivity with a lower coefficient of thermal expansion, so they are improved in resistance to thermal fatigue and are less susceptible to peeling.

Typical high-Cr ferritic steels which have conventionally been used include 9Cr-1Mo steel (ASTM T9), modified 9Cr-1Mo steel (ASTM SA213 T91), and 12Cr-1Mo steel (DIN X20CrMoWV 121). For the purpose of improvement in high-temperature strength, it has been proposed to modify these steels by adding one or more elements selected from Mo, W, V, Nb and N. See, for example, Japanese Patent Publication No. 57-36341(1982), No. 62-8502(1987), and No. 62-12304(1987), and Japanese Patent Application Laid-Open No. 59-211553(1984), No. 61-110753(1986), No. 62-297435(1987), and No. 2-310340(1990).

In U.S. Pat. No. 5,069,870 and Japanese Patent Application Laid-Open No. 3-97832(1991), some of the present inventors proposed a high-Cr ferritic, heat-resistant steel having a Cu-containing novel composition on the basis of a finding that the addition of Cu is effective for improving the resistance to high-temperature oxidation at temperatures of suppressing the formation of δ-ferrite, which is caused by the presence of Cr in an increased amount. Therefore, the amount of Ni, which has conventionally been added for the same purpose, can be decreased, and as a result, the material costs can be decreased without a decrease in the thermal conductivity of the steel.

In the Japanese journal *Current Advances in Materials and Processes,* Vol. 4, No. 3, p. 884 (1991), it is reported that the addition of Cu has an effect of suppressing the formation of δ-ferrite in weld zones of a high-Cr ferritic steel, thereby improving the toughness in those zones. Likewise, Japanese Patent Application Laid-Open No. 2-294452(1990) describes a Cu-containing, high-Cr ferritic, heat-resistant steel which has improved toughness in weld zones by the above-described action of Cu.

As discussed above, many modifications have been made to high-Cr ferritic, heat-resistant steels which contains at least 9% by weight of Cr. However, the steel compositions heretofore proposed for these steels are still unsatisfactory with respect to at least one of toughness, stability of the structure, workability, and weldability, as described below.

(1) The weldability and workability of a high-Cr ferritic steel can be improved by decreasing the C content thereof. However, decreasing the C content is accompanied by the formation of δ-ferrite in a large amount in the base metal and/or the weld zones of the steel, resulting in losses of toughness and high-temperature strength.

(2) The addition of a relatively large amount of Ni, which is known to be effective in suppressing the formation of δ-ferrite, not only decreases the thermal conductivity of the steel and raises the cost thereof, but also accelerates the coarsening of carbide precipitates during use at high temperatures, resulting in a decrease in high-temperature creep strength.

(3) When Cu is added in order to suppress the formation of δ-ferrite, the simultaneous addition of a slight amount of Mg is advantageous from the viewpoint of avoiding a deterioration in workability, which is caused by the addition of Cu, as disclosed in the afore-mentioned U.S. Pat. No. 5,069,870. However, since Mg is difficult to melt, it is difficult to prepare such an Mg-containing steel by melting.

(4) The workability of a Cu-containing steel can also be improved by allowing a small portion of δ-ferrite phases to remain in the steel, as disclosed in Japanese Patent Application Laid-Open No. 3-97832(1991), in place of the addition of a slight amount of Mg. Such a steel in which slight amounts of δ-ferrite remain, however, has a decreased toughness, particularly in weld zones.

(5) The so-called copper checking phenomenon generally occurs in steels which contain a relatively large amount of Cu. Copper checking is caused by intergranular precipitation of Cu phases at high temperatures and results in cracking during working. Copper checking of Cu-containing steels can be avoided by the addition of Ni in an amount of at least 50% by weight of the Cu content. This measure is satisfactory with low-alloy steels, but the addition of such a large amount of Ni to high-Cr steels does not solve the problem mentioned in (2) above.

SUMMARY OF THE INVENTION

It is an object of the present invention to totally solve the problems described in (1) to (5) above.

A more specific object of the invention is to provide a high-Cr ferritic, Cu-containing, heat-resistant steel which exhibits improved strength and resistance to hot corrosion and oxidation and improved toughness as well as good workability and weldability and which is free from copper checking.

The present invention provides a high-Cr ferritic, heat-resistant steel having improved resistance to copper checking which consists essentially, on a weight basis, of:

| | | | |
|---|---|---|---|
| C: | 0.03–0.15%, | Si: | at most 0.7%, |
| Mn: | 0.1–1.5%, | Ni: | 0.05–1.0%, |
| Cr: | 8–14%, | W: | 0.8–3.5%, |
| V: | 0.1–0.3%, | Nb: | 0.01–0.2%, |
| N: | 0.001–0.1%, | Al: | at most 0.05%, |
| Cu: | 0.4–3.5%, | | |

optionally B: 0.0001–0.02% and/or one or more elements selected from the group consisting of La, Ce, Ca, Y, Ti, Zr, and Ta: 0.01–0.2% each, and a balance of Fe and incidental impurities, wherein the Cu and Ni contents satisfy the following Inequality (A):

$$2.5 \leqq (\%Cu)/(\%Ni) \leqq 4.5 \quad (A).$$

DETAILED DESCRIPTION OF THE INVENTION

Figure 1:
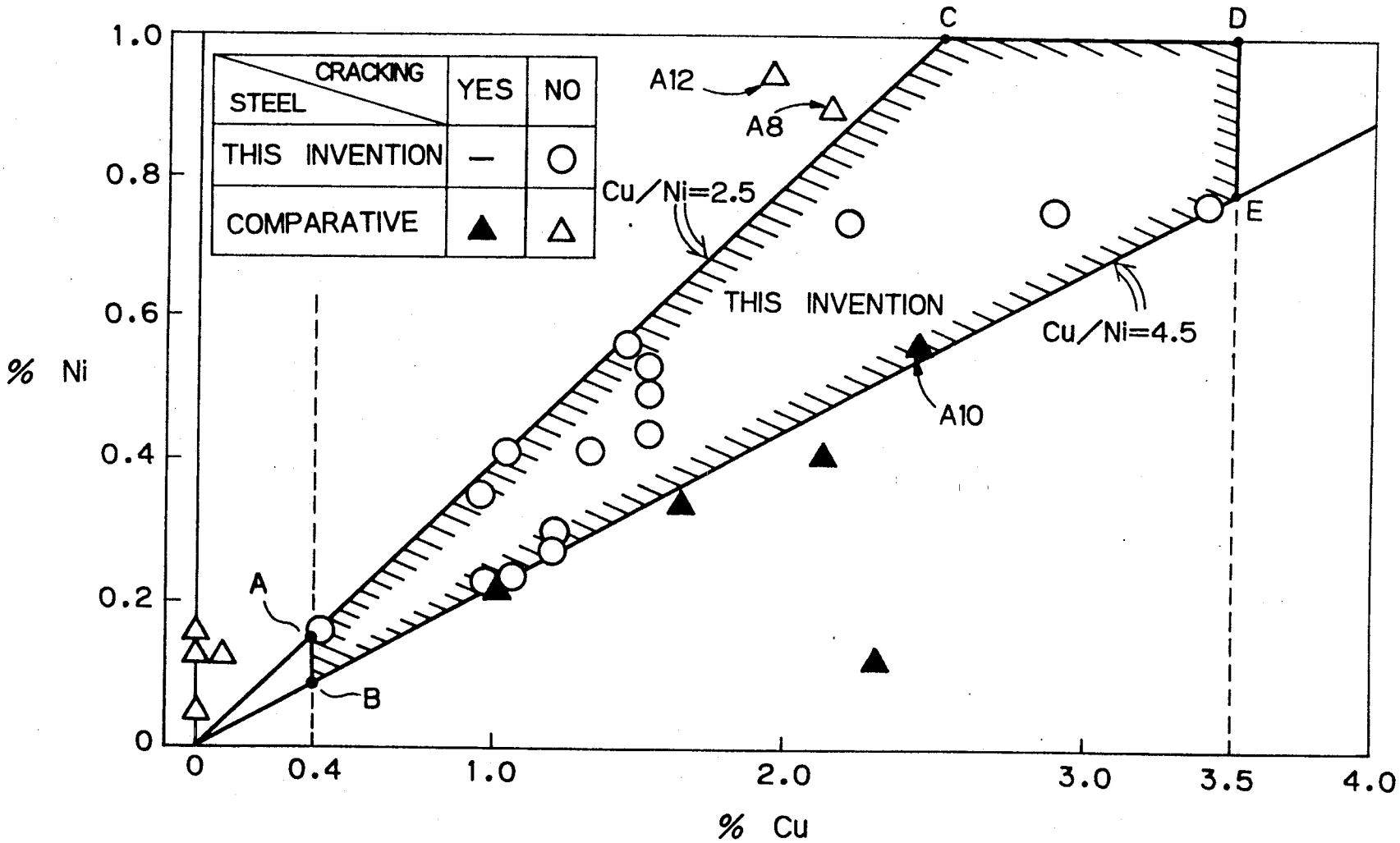
FIG. 1 shows the Cu and Ni contents of the Cu-containing, high-Cr ferritic steels prepared in the example along with the results of a copper-checking test.

In the following description, all percents are by weight as far as steel compositions are concerned.

The high-Cr ferritic, heat-resistant steel according to the present invention exhibits excellent properties, i.e., strength and resistance to corrosion and oxidation at high temperatures and toughness both in the base metal and weld zones without causing copper checking as an overall effect of the addition of the above alloying elements in optimum proportions. Major characteristics of the steel are as follows.

(a) The addition of Cu is employed for the purpose of suppressing the formation of δ-ferrite and hence improving the toughness in the base metal and weld zones of the steel. At the same time, Ni is also added as a simple and effective measure for preventing a Cu-containing steel from suffering copper checking. However, the amount of Ni added is minimized such that the costs, thermal conductivity, and the strength of the steel are not substantially impaired.

(b) The steel is free from Mo, which is usually added to high-Cr steels with or without W for improving the high-temperature strength. Mo and W are both solid-solution hardening and precipitation-hardening elements. The improved high-temperature strength of the steel of the present invention is maintained by a single addition of W. Surprisingly, it has been found that the elimination of Mo is effective for improvement of long-term creep rupture strength of high-Cr ferritic steels and that W has an effect of suppressing copper checking in Cu-containing steels.

(c) In view of the favorable effect of W on copper checking, the amount of Ni, which is added for the prevention of copper checking, is restricted to an extremely small amount compared to the amount of Ni conventionally added to low-alloy steels for the same purpose. The Ni content is also restricted based on the Cu content by the foregoing Inequality (A), which defines the range in which the copper checking phenomenon is prevented. In low-alloy steels, it is quite common that Ni is added in such a large amount that the ratio of (%Cu)/(%Ni) is at most 2.

As described previously, copper checking of a Cu-containing steel is caused by precipitation of Cu phases (which have a relatively low melting point) at the grain boundaries at high temperatures. It was explained in the prior art that the addition of a relatively large amount of Ni causes the formation of Cu—Ni complete solid solution phases having a higher melting point than Cu phases, resulting in strengthening the grain boundaries and thereby preventing the occurrence of copper checking. To this end, however, it was considered necessary to add Ni in such a large amount that the ratio of (%Cu)/(%Ni) was at most 2 or in an amount of at least 50% of the Cu content.

For example, in the steels disclosed in the afore-mentioned Japanese Patent Application Laid-Open No. 62-12304(1987), Cu and Ni are added in amounts of 0.4–1.5% and 0.3–1.5%, respectively, to a high-Cr steel. However, the steel contains 0.5%–2% Mo, i.e., it can be said to be a high-Mo, low-W steel. Therefore, most of the steels illustrated in the examples of this patent application have an Ni content nearly equal to the Cu content. Likewise, the steels disclosed in the afore-mentioned Japanese Patent Application Laid-Open No. 2-294452(1990) contain Mo as an essential alloying element and copper checking is not taken into consideration at all in these steels.

According to the present invention, the high-Cr steel composition is free from Mo, and the required high-temperature strength is assured by the addition of W alone with the view of preventing the formation of δ-ferrite as much as possible. Inasmuch as the formation of δ-ferrite is suppressed in this way, it is possible to prevent low-melting Cu phases from precipitating at the grain boundaries between δ-ferrite and martensite. It has also been found that W itself has an effect of suppressing the precipitation of Cu phases at such grain boundaries or at the scale-metal interfaces.

When 0.8% or more W is added to a 8–14% Cr-containing steel without the addition of Mo, as described above, the addition of Mg for the purpose of improvement in hot workability becomes unnecessary. Furthermore, insofar as the steel is substantially free from δ-ferrite, undesirable copper checking does not occur even if the (%Cu)/(%Ni) ratio is in the range of from 2.5 to 4.5, which is in excess of 2, and the steel does not suffer anymore in respect to hot workability. Thus, it is one of the major features of the present invention that a relatively small amount of Ni is added in combination with a relatively large amount of Cu.

The reason for restricting the content of each alloying element as above will be described below together with the function of each alloying element.

C (carbon)

C combines with Cr, Fe, W, V, and Nb to form carbides of these elements, thereby improving the high-temperature strength of the steel. Furthermore, C itself is an austenite-stabilizing element and serves to stabilize the steel structure. A carbon content of less than 0.03% not only cannot precipitate carbides in a sufficient amount, but also results in the formation of an increased amount of δ-ferrite, thereby leading to a loss of strength and toughness. When the C content is higher than 0.15%, carbides are precipitated excessively and hence the steel is hardened to such a degree that workability and weldability are undesirably impaired. Therefore, the proper C content is in the range of 0.03–0.15% Preferably the C content is 0.06–0.13%.

Cr (chromium)

Cr is an essential element for improving the resistance to oxidation and hot corrosion of the steel. When the Cr content is less than 8%, the steel does not have a sufficient level of resistance to oxidation and hot corrosion desired for a high-Cr steel. A Cr content of greater than 14% causes the formation of δ-ferrite in an increased amount and therefore the strength, workability, and toughness of the steel are impaired. Thus, the Cr content is within the range of 8–14% and preferably 9–12%.

Si (silicon)

Si is added as a deoxidizer and serves to improve the resistance of the steel to steam oxidation. However, the addition of Si in excess of 0.7% leads to a significant loss of toughness and it also adversely affects the creep strength of the steel. Particularly for thick-walled pipes and plates, it is desirable to minimize the Si content in order to suppress embrittlement of the steel caused by a long-term heating. Therefore, the Si content is limited to at most 0.7%. Preferably the Si content is 0.01–0.7% and more preferably 0.01–0.2%.

Mn (manganese)

Mn serves to improve the hot-workability of the steel and is also effective for stabilization of the steel structure. At an Mn content of less than 0.1%, these effects cannot be expected. The addition of Mn in an amount exceeding 1.5% causes the steel to harden extremely, leading to a loss of workability and weldability. Therefore, the Mn content is in the range of 0.1–1.5%. Preferably the Mn content is 0.3–1.0%.

Ni (nickel)

Ni is an austenite-stabilizing element and thereby serves to suppress the formation of δ-ferrite and stabilize the martensitic structure. As described above, Ni has another effect of preventing copper checking. These effects cannot be obtained significantly at an Ni content of less than 0.05%, while the addition of Ni in an excessive amount adds to the material costs of the steel and is undesirable from the standpoint of economy. Moreover, the addition of an excessive amount of Ni so decreases the transformation temperatures of the steel that it becomes difficult to subject the steel to tempering sufficiently, and it also results in a loss of high-temperature creep strength. Thus, it is desirable for a high-Cr ferritic, heat-resistant steel to have a minimized Ni content Therefore, the Ni content is in the range of 0.05–1.0%. Preferably the Ni content is 0.1–0.8% and more preferably 0.1–0.6%.

W (tungsten)

W is one of the important alloying elements in the steel of the present invention and it serves to strengthen the steel not only by the solid-solution hardening effect but also by the precipitation-hardenening effect resulting from the formation of finely dispersed carbides. As a result, W is highly effective in improving the creep strength of the steel significantly.

W is usually added to a high-Cr steel in combination with Mo, which has similar effects to W. According to the present invention, however, Mo is not added and the steel is strengthened by the addition of W alone. This is because Mo has a higher tendency to accelerate the formation of δ-ferrite. As a result, the addition of Mo not only causes the precipitation of Cu phases at the grain boundaries between ferrite and martensite, leading to a loss of workability and strength but also tends to form δ-ferrite, particularly in weld heat-affected zones, leading to a loss of toughness.

Compared to Mo, W has a lower tendency toward acceleration of the formation of δ-ferrite. Moreover, W has an effect of preventing copper checking and it is more effective than Mo for improving the long-term creep strength at high temperatures. These favorable effects attained by the addition of W alone in the absence of Mo prevail over the cost disadvantage of W, since it is necessary to add about twice as much W as Mo on a weight basis in order to assure the same level of strength.

The addition of W in an amount of less than 0.8% cannot attain the desired effects, while the addition of more than 3.5% W causes the formation of δ-ferrite and hardens the steel extremely, leading to a loss of toughness and workability. Therefore, the proper W content is 0.8–3.5%. Preferably the W content is 1.5–2.5%.

V (vanadium)

V primarily combines with C and N to form finely-dispersed V(CN) precipitates, thereby contributing to improve the strength of the steel. Particularly, when a relatively large amount of N is added, the precipitates formed by the addition of V are comprised predominantly of VN (vanadium nitride), which is effective for improving creep strength. These effects are not attained when the V content is less than 0.1%. However, the addition of more than 0.3% V causes an undesirable deterioration in strength due to an increase in the amount of V which is present in solid solution. Therefore, V is added in an amount of 0.1–0.3% and preferably 0.15–0.25%.

Nb (niobium)

Like V, Nb also primarily combines with C and N to form finely-dispersed Nb(C,N), thereby contributing to improved creep strength. These precipitates are effective for improvement in short-term creep strength and also contribute to refinement of austenitic grains during normalizing, thereby causing an improvement in toughness. These effects are not attained sufficiently when the Nb content is less than 0.01%. The addition of more than 0.2% Nb increases the amount of Nb(C,N) which remains undissolved after normalizing heat treatment, and the strength and weldability of the steel are impaired. Furthermore, the finely-dispersed precipitates agglomerate into coarse particles during creep, resulting in a deterioration in creep strength. Therefore, Nb is added in an amount of 0.01–0.2%, preferably 0.03–0.1%, and more preferably 0.03–0.08%.

Al (soluble aluminum)

Al is added as a deoxidizer with a maximum content of 0.05% since the addition of greater than 0.05% Al adversely affects the creep strength of the steel. Preferably, the Al content is in the range of 0.005–0.025%.

N (nitrogen)

N combines with V and Nb to form finely-dispersed carbonitrides, which are effective for improving the creep strength of the steel. Particularly in a high-Cr ferritic steel, N forms VN as stably-dispersed precipitates and contributes to improvement in long-term creep strength. The addition of less than 0.001% N is not sufficiently effective, while the addition of more than 0.1% N adversely affects the weldability and workability. Therefore, N is added in an amount of 0.001–0.1% and preferably 0.02–0.07%.

Cu (copper)

Cu, which is another important alloying element of the high-Cr steel of the present invention, has the effects of (1) improving the resistance to hot corrosion and oxidation, (2) acting as an inexpensive austenite-forming element and suppressing the formation of δ-ferrite, thereby improving the strength and toughness at a lower cost than Ni, (3) causing a smaller drop of $Ac_1$ point than Ni, thereby making it possible to add Cu in a larger amount without adversely affecting the creep strength, and (4) preventing the formation of softened areas in weld heat-affected zones, thereby improving the strength of weld zones.

These effects are not sufficient at a Cu content of less than 0.4%, while the addition of more than 3.5% Cu causes the precipitation of Cu phases at the grain boundaries, thereby impairing the ductility, high-temperature strength, weldability, and workability of the steel. Therefore, Cu is added in an amount of 0.4–3.5%, preferably 0.7–2.0%, and more preferably 0.7–1.7%.

Within the Ni and Cu contents described above, it is also necessary to adjust the relative amounts of Ni and Cu so as to satisfy the following Inequality (A):

$$2.5 \leqq (\%Cu)/(\%Ni) \leqq 4.5 \quad \text{(A).}$$

In conventional Cu-containing steels in which Ni is added in order to prevent copper checking, it was usual to add a relatively large amount of Ni such that the ratio of (%Cu)/(%Ni) was 2 or smaller. However, for the high-Cr alloy steel compositions according to the present invention, it has been found that Cu can be added without causing copper checking or with maintaining a sufficient level of workability as long as the ratio of (%Cu)/(%Ni) is between 2.5 to 4.5. In other words, an increased amount of Cu can be added with the addition of a decreased amount of Ni to prevent copper checking.

Compared to prevention of copper checking in a Cu-containing high-Cr steel by the addition of Mg, the prevention of copper checking in the high-Cr steel of the present invention can be attained more easily and more inexpensively. Compared to prevention of copper checking by leaving a slight amount of δ-ferrite in the steel, the copper checking-free high-Cr steel of the present invention has significantly improved toughness and can be effectively applied to thick-walled parts.

The addition of a larger amount of Ni such that the (%Cu)/(%Ni) ratio is less than 2.5 results in an increase in material costs and a decrease in creep strength and it undesirably lowers the $Ac_1$ point of the steel, thereby making tempering or softening annealing treatment difficult. A (%Cu)/(%Ni) ratio of greater than 4.5 is not effective for complete prevention of copper checking during hot working and adversely affects the strength of the steel in that the creep ductility is impaired. Preferably, the (%Cu)/(%Ni) ratio is between 3 and 4.

In one embodiment of the present invention, the high-Cr ferritic, heat-resistant steel consists essentially of the above-described alloying elements and a balance of Fe and incidental impurities.

In another embodiment, the high-Cr steel of the present invention may contain, in addition to the above essential alloying elements, B and/or at least one element selected from La, Ce, Y, Ca, Ti, Zr, and Ta as an optional alloying element.

B (boron)

The addition of a very slight amount of B is effective for dispersing and stabilizing carbides, thereby improving the strength of the steel. This effect of B is not significant when the B content is less than 0.0001%. The addition of more than 0.02% B results in a significant deterioration in workability and weldability. Therefore, when added, B is present in an amount of 0.0001–0.02% and preferably 0.001–0.005%.

La (lanthanum), Ce (cerium), Y (yttrium), Ca (calcium), Ti (titanium), Zr (zirconium), Ta (tantalum)

These elements serves to fix and stabilize harmful impurities such as P, S, and 0, thereby changing the shape of the non-metal inclusions into a stable and harmless form. Such a non-metal inclusion shape-controlling effect can be attained by the addition of one or more of these elements each in an amount of at least 0.01% and the resulting steel has improved toughness, strength, and workability. When the amount of at least one of these elements is more than 0.2%, the amount of non-metal inclusions formed during melting is so increased that the toughness, strength, and workability are impaired. Therefore, when added, at least one of these elements is present in an amount of 0.01–0.2% and preferably 0.02–0.15% for each metal. It is possible to add one or more of these elements along with B.

The balance of the steel consists essentially of Fe and incidental impurities. Typical harmful impurities incidentally present in the heat-resistant steel are P (phosphorus), S (sulfur), and 0 (oxygen). In general, an acceptable upper limit is 0.025% on the P content, 0.015% on the S content, and 0.005% on the 0 content, and it is desirable that the contents of these impurities be as low as possible. The resulting steel with minimized non-metal inclusions has improved toughness, workability, strength, and weldability.

After preparation and hot working into a desired final or intermediate shape, the high-Cr ferritic, heat-resistant steel of the present invention is usually subjected to heat treatment. A typical heat treatment is a combination of normalizing and tempering such that the steel which is used has a martensitic single-phase structure which is free from δ-ferrite phases. When the ductility of the steel is of importance, annealing may be applied so as to use the steel with an (δ-ferrite+carbonitride) structure.

Usually, the normalizing or annealing is conducted in the temperature range of 1000°–1200 ° C. and preferably 1030°–1100 ° C. The temperature at which the tempering treatment is performed following normalizing is usually in the range of ° C. to the $Ac_1$ point of the steel when the $Ac_1$ point is 830 ° C. or below. When the steel is not tempered sufficiently, it tends to have a lower creep strength. In order that the desired creep properties of the steel will be stable, it is preferred to subject the steel to heat treatment in such conditions that the resulting heat-treated steel has a tensile strength of 65–80 kgf/mm$^2$ at room temperature.

The following example is presented as an illustration of the present invention. It should be understood, however, that the invention is not limited to the specific details set forth in the example.

EXAMPLE

Each of the high-Cr steels having the compositions shown in Table 1 was melted in a 150 kg vacuum melting furnace and cast into an ingot. The ingot was forged in a temperature range of 1150°-950 ° C. to form a 20 mm-thick plate.

Among the comparative steels shown in Table 1 (indicated as Al to All), Steel Al was ASTM T9, Steel A2 was a 9Cr-2Mo steel designated as STBA 27 in the Boiler Specifications of the Japanese Thermal and Nuclear Power Generation Engineering Institute, Steel A3 was ASTM A213 T91, and Steel A4 was DIN X20 CrMoWV121. All of these comparative steels are typical high-Cr ferritic steel which have conventionally been used in the art. Steels A5 to A9 and A13 were Mo-containing comparative steels and Steels A10 to A12 were Mo-free comparative steels, all of which, except Steel A10 and A13, had a (%Cu)/(%Ni) ratio which did not satisfy the foregoing Inequality (A). Comparative Steel A10 had a (%Cu)/(%Ni) ratio satisfying Inequality (A) but its W content was lower than the minimum content defined herein. The remaining steels indicated as Steels B1 to B15 in Table 1 were Mo-free steels according to the present invention.

Steels A1 and A2 were subjected to a conventional heat treatment, which was normalizing-tempering treatment consisting of heating at 950 ° C. for 1 hour followed by air cooling (normalizing) and subsequent heating at 750 ° C. for 1 hour followed by air cooling (tempering).

The remaining Steels A3 to A13 and B1 to B15 were subjected to normalizing-tempering heat treatment, which consisted of heating at 1050 ° C. for 1 hour followed by air cooling (normalizing) and subsequent heating at 770 ° C. for 3 hours followed by air cooling (tempering).

Each of the heat-treated steels was evaluated by a tensile test, a creep rupture test, a Charpy impact test, and a copper checking test.

The tensile test was performed at room temperature and 650 ° C. using tensile test bars having a gauge length of 30 mm and a diameter of 6 mm to determine the tensile strength, 0.2% proof stress, and elongation.

Test bars of the same dimensions as above were used in the creep rupture test, which was performed at 650 ° C. for up to 10,000 ($=10^4$) hours. The results were expressed as values for creep rupture strength at 650 ° C. after $10^4$ hours (650° C.$\times 10^4$h), as determined by interpolation.

The Charpy impact test was performed at 0 ° C. with 2 mm V-notched test pieces (JIS No. 4 test pieces) having dimensions of 10×10×55 (mm).

The copper checking test was performed by heating a test plate measuring 20 mm (thickness), 200 mm (width), and 400 mm (length) at 1150 ° C. for 1 hour followed by rolling with two passes to obtain a reduction in thickness of 30% for each pass. The end and main surfaces of the as-rolled plate were observed visually and under an optical microscope to determine whether checking or cracking had occurred.

The test results are shown in Table 2 and FIG. 1. FIG. 1 shows the Cu and Ni contents of the high-Cr ferritic steels prepared in the example along with the results of the copper-checking test. The hatched area in FIG. 1 corresponds to the range satisfying the foregoing Inequality (A). In FIG. 1, Points A to E correspond to the following Cu and Ni contents: A (0.4% Cu, 0.16% Ni), B (0.4% Cu, 0.09% Ni), C (2.5% Cu, 1.0% Ni), D (3.5% Cu, 1.0% Ni), E (3.5% Cu, 0.78% Ni).

It is apparent from Table 2 and FIG. 1 that copper checking did not occur in all the steels of the present invention tested, demonstrating that the addition of Cu, Ni, and W in appropriate amounts according to the invention was effective for prevention of copper checking. In contrast, Comparative Steels A10 and A13 suffered copper checking in spite of the (%Cu)/(%Ni) ratio of 4.3 and 4.4, respectively, which fell within the range defined herein. The reason therefor is considered to be attributable to its low W content of 0.75% for Steel A10 and the addition of Mo for Steel A13.

Comparative Steels A8 and A12 in which Ni was added excessively were also prevented from copper checking. However, the creep rupture strengths of these comparative steels at 650 ° C.$\times 10^4$ h were as low as 8.2 kgf/mm$^2$ and 8.0 kgf/mm$^2$, respectively. In contrast, all the steels of the present invention exhibited a higher creep rupture strength of 9.5 kgf/mm$^2$ at lowest and their creep rupture strength was superior to any of the comparative steels, including conventional high-Cr steels. The tensile properties and toughness of the steels of the present invention were also comparable or superior to the comparative steels.

As described above, the Cu-containing, high-Cr ferritic, heat-resistant steels of the present invention, which contain a minimized amount of Ni relative to Cu, are excellent in strength, toughness, resistance to hot corrosion and oxidation, and economy, and they are also excellent in workability in that copper checking is prevented. Therefore, they can be successfully used as hot-forged or hot-rolled structural members for boilers, heat exchangers, and the like in the chemical and nuclear power industries, particularly in the form of thick-walled heat- and pressure-resistant members, plates, or pipes.

Although the present invention has been described with respect to preferred embodiments, it is to be understood that variations and modifications may be employed without departing from the concept of the invention as defined in the following claims.

TABLE 1

Steel Composition (Comparative Steels)

(% by weight, Fe: Balance)

| No. | C | Si | Mn | P | S | Ni | Cr | Mo | W | V | Nb | Al | Cu | N | Cu/Ni | Remarks |
|---|---|---|---|---|---|---|---|---|---|---|---|---|---|---|---|---|
| A1 | 0.12 | 0.42 | 0.55 | 0.021 | 0.003 | 0.13 | 8.98 | 1.02 | — | — | — | 0.001 | 0.01 | 0.015 | 0.08 | STBA26 |
| A2 | 0.08 | 0.35 | 0.52 | 0.012 | 0.002 | 0.13 | 9.24 | 2.03 | — | — | — | 0.012 | 0.01 | 0.014 | 0.08 | STBA27 |
| A3 | 0.10 | 0.25 | 0.45 | 0.005 | 0.001 | 0.05 | 8.52 | 0.98 | — | 0.22 | 0.08 | 0.014 | 0.01 | 0.051 | 0.2 | SA213T91 |
| A4 | 0.22 | 0.53 | 0.65 | 0.025 | 0.003 | 0.16 | 12.12 | 1.05 | 0.45 | 0.32 | — | 0.021 | 0.01 | 0.035 | 0.06 | X20CrMoWV121 |
| A5 | 0.10 | 0.15 | 0.55 | 0.016 | 0.001 | 0.12 | 12.35 | 1.03 | 1.02 | 0.25 | 0.06 | 0.012 | 0.10 | 0.055 | 0.8 | |
| A6 | 0.11 | 0.33 | 0.67 | 0.023 | 0.002 | 0.13 | 11.25 | 0.12 | 2.03 | 0.22 | 0.06 | 0.002 | 2.32 | 0.045 | 17.8 | |
| A7 | 0.09 | 0.06 | 0.56 | 0.005 | 0.002 | 0.22 | 9.35 | 0.51 | 1.52 | 0.19 | 0.06 | 0.012 | 1.03 | 0.051 | 4.7 | |
| A8 | 0.11 | 0.07 | 0.45 | 0.015 | 0.001 | 0.90 | 9.12 | 0.51 | 1.53 | 0.21 | 0.06 | 0.006 | 2.15 | 0.052 | 2.4 | |
| A9 | 0.12 | 0.06 | 0.68 | 0.025 | 0.003 | 0.41 | 11.32 | 2.05 | 0.45 | 0.25 | 0.07 | 0.012 | 2.13 | 0.054 | 5.3 | |
| A10 | 0.09 | 0.12 | 0.45 | 0.021 | 0.001 | 0.57 | 11.23 | — | 0.75 | 0.22 | 0.04 | 0.005 | 2.45 | 0.047 | 4.3 | |

TABLE 1-continued

| | | | | | | | | | | | | | | | |
|---|---|---|---|---|---|---|---|---|---|---|---|---|---|---|---|
| A11 | 0.15 | 0.23 | 0.80 | 0.021 | 0.002 | 0.34 | 11.02 | — | 1.50 | 0.25 | 0.05 | 0.023 | 1.65 | 0.044 | 4.9 |
| A12 | 0.08 | 0.22 | 0.75 | 0.018 | 0.002 | 0.95 | 10.89 | — | 1.87 | 0.23 | 0.04 | 0.021 | 1.95 | 0.065 | 2.1 |
| A13 | 0.09 | 0.07 | 0.57 | 0.020 | 0.001 | 0.23 | 10.60 | 0.50 | 1.60 | 0.26 | 0.07 | 0.026 | 1.01 | 0.066 | 4.4 |

Steel Composition (Present Invention Steels)

| No. | C | Si | Mn | P | S | Ni | Cr | Mo | W | V | Nb | Al | Cu | N | Cu/Ni | (% by weight, Fe: Balance) Others |
|---|---|---|---|---|---|---|---|---|---|---|---|---|---|---|---|---|
| B1 | 0.11 | 0.02 | 0.55 | 0.005 | 0.002 | 0.35 | 11.02 | — | 1.85 | 0.26 | 0.07 | 0.015 | 0.95 | 0.056 | 2.7 | Ca = 0.12 |
| B2 | 0.12 | 0.05 | 0.65 | 0.024 | 0.003 | 0.23 | 10.85 | — | 2.23 | 0.19 | 0.04 | 0.004 | 0.98 | 0.035 | 4.3 | Ti = 0.07 |
| B3 | 0.12 | 0.02 | 1.42 | 0.004 | 0.001 | 0.16 | 8.72 | — | 1.85 | 0.15 | 0.15 | 0.045 | 0.42 | 0.002 | 2.6 | La = 0.10, Ce = 0.05 |
| B4 | 0.11 | 0.07 | 0.89 | 0.005 | 0.001 | 0.49 | 9.87 | — | 0.85 | 0.12 | 0.12 | 0.032 | 1.53 | 0.025 | 3.1 | Y = 0.12 |
| B5 | 0.07 | 0.02 | 0.65 | 0.021 | 0.003 | 0.76 | 10.53 | — | 1.58 | 0.28 | 0.03 | 0.002 | 2.89 | 0.058 | 3.8 | B = 0.005 |
| B6 | 0.06 | 0.45 | 0.35 | 0.018 | 0.001 | 0.77 | 9.78 | — | 3.45 | 0.26 | 0.06 | 0.004 | 3.42 | 0.078 | 4.4 | B = 0.003, Zr = 0.05 |
| B7 | 0.08 | 0.55 | 0.56 | 0.021 | 0.001 | 0.74 | 8.52 | — | 2.42 | 0.16 | 0.12 | 0.002 | 2.21 | 0.055 | 3.0 | Ta = 0.03 |
| B8 | 0.11 | 0.35 | 0.54 | 0.024 | 0.002 | 0.44 | 10.58 | — | 2.21 | 0.24 | 0.05 | 0.005 | 1.53 | 0.065 | 3.5 | Zr = 0.02 |
| B9 | 0.14 | 0.24 | 0.15 | 0.017 | 0.001 | 0.56 | 13.21 | — | 1.95 | 0.27 | 0.06 | 0.009 | 1.45 | 0.063 | 2.6 | Ca = 0.05, Ce = 0.08 B = 0.005 |
| B10 | 0.09 | 0.05 | 0.55 | 0.003 | 0.001 | 0.41 | 11.02 | — | 2.45 | 0.22 | 0.02 | 0.002 | 1.05 | 0.032 | 2.6 | Ta = 0.12, Y = 0.05 |
| B11 | 0.10 | 0.06 | 0.56 | 0.004 | 0.001 | 0.53 | 10.54 | — | 2.01 | 0.20 | 0.09 | 0.008 | 1.54 | 0.045 | 2.9 | B = 0.006, Ti = 0.07 |
| B12 | 0.11 | 0.03 | 0.55 | 0.015 | 0.002 | 0.41 | 10.56 | — | 1.98 | 0.16 | 0.04 | 0.023 | 1.32 | 0.056 | 3.2 | La = 0.05 |
| B13 | 0.08 | 0.07 | 0.54 | 0.021 | 0.002 | 0.30 | 10.78 | — | 1.47 | 0.19 | 0.03 | 0.021 | 1.21 | 0.055 | 4.0 | La = 0.02, Zr = 0.04 B = 0.002 |
| B14 | 0.09 | 0.08 | 0.55 | 0.021 | 0.001 | 0.24 | 10.56 | — | 1.98 | 0.26 | 0.07 | 0.028 | 1.06 | 0.064 | 4.4 | — |
| B15 | 0.11 | 0.05 | 0.58 | 0.025 | 0.001 | 0.27 | 10.78 | — | 2.45 | 0.21 | 0.05 | 0.036 | 1.20 | 0.058 | 4.4 | — |

TABLE 2

| No. | Tensile Properties at Room Temperature: Tensile Strength (kgf/mm²) | 0.2% Proof Stress (kgf/mm²) | El. (%) | Tensile Properties at 650° C.: Tensile Strength (kgf/mm²) | 0.2% Proof Stress (kgf/mm²) | El. (%) | 0°C. Impact Strength (kgf · m/cm²) | Creep Rupture Strength (kgf/mm²) | Occurrence of Copper Checking on Rolling |
|---|---|---|---|---|---|---|---|---|---|
| Test Results (Comparative Steels) | | | | | | | | | |
| A1 | 75.3 | 54.6 | 23.8 | 24.1 | 19.7 | 45.9 | 13.8 | 3.7 | None |
| A2 | 64.7 | 51.0 | 25.8 | 26.1 | 18.3 | 38.7 | 17.5 | 3.6 | " |
| A3 | 68.7 | 49.7 | 22.6 | 24.3 | 19.8 | 31.2 | 31.3 | 8.2 | " |
| A4 | 79.5 | 55.6 | 23.1 | 28.5 | 20.1 | 31.3 | 11.5 | 5.4 | " |
| A5 | 68.5 | 51.3 | 26.8 | 26.8 | 21.2 | 33.3 | 9.7 | 8.5 | " |
| A6 | 83.2 | 63.5 | 18.9 | 33.2 | 23.7 | 25.6 | 9.4 | 8.3 | Cracked |
| A7 | 78.4 | 60.5 | 21.3 | 29.6 | 21.4 | 27.8 | 31.2 | 9.3 | " |
| A8 | 80.3 | 61.5 | 20.8 | 31.7 | 21.5 | 28.8 | 31.3 | 8.2 | None |
| A9 | 85.0 | 62.1 | 17.6 | 32.8 | 24.1 | 23.2 | 10.5 | 8.5 | Cracked |
| A10 | 75.1 | 53.2 | 20.4 | 23.4 | 20.1 | 22.4 | 9.7 | 9.1 | " |
| A11 | 84.9 | 65.1 | 17.5 | 31.5 | 25.6 | 22.7 | 10.5 | 8.1 | " |
| A12 | 73.2 | 51.4 | 22.1 | 23.1 | 20.4 | 29.4 | 5.4 | 8.0 | None |
| A13 | 77.0 | 53.0 | 22.0 | 27.3 | 21.0 | 30.1 | 16.5 | 9.5 | Cracked |
| Test Results (Present Invention Steels) | | | | | | | | | |
| B1 | 78.3 | 58.4 | 23.1 | 25.7 | 20.6 | 33.4 | 12.8 | 9.8 | None |
| B2 | 80.2 | 61.3 | 22.4 | 30.4 | 24.1 | 30.4 | 10.8 | 10.3 | " |
| B3 | 75.4 | 53.1 | 24.3 | 25.3 | 20.5 | 35.1 | 31.2 | 9.5 | " |
| B4 | 72.8 | 52.0 | 23.8 | 24.1 | 20.4 | 33.2 | 28.9 | 9.8 | " |
| B5 | 77.3 | 54.9 | 22.7 | 27.3 | 23.2 | 31.5 | 15.7 | 10.5 | " |
| B6 | 77.8 | 53.7 | 22.4 | 26.9 | 21.2 | 33.3 | 31.2 | 10.7 | " |
| B7 | 77.1 | 53.6 | 25.4 | 27.3 | 22.8 | 34.2 | 29.1 | 10.8 | " |
| B8 | 79.5 | 56.3 | 23.7 | 28.3 | 21.9 | 32.5 | 14.6 | 11.4 | " |
| B9 | 82.3 | 63.5 | 21.5 | 30.3 | 25.6 | 31.3 | 11.5 | 9.6 | " |
| B10 | 78.5 | 54.1 | 24.3 | 26.7 | 21.5 | 33.8 | 14.8 | 10.1 | " |
| B11 | 76.9 | 53.1 | 22.4 | 27.6 | 22.1 | 31.8 | 17.6 | 11.5 | " |
| B12 | 78.2 | 54.1 | 23.1 | 25.3 | 21.0 | 31.5 | 13.8 | 9.8 | " |
| B13 | 76.1 | 52.8 | 22.1 | 24.3 | 20.8 | 33.8 | 12.8 | 10.5 | " |
| B14 | 77.5 | 53.7 | 21.8 | 27.8 | 21.4 | 32.1 | 17.5 | 10.1 | " |
| B15 | 81.3 | 61.2 | 21.5 | 30.1 | 25.0 | 30.5 | 16.6 | 9.9 | " |

What is claimed is:

1. A high-Cr ferritic, heat-resistant steel having improved resistance to copper checking which consists essentially, on a weight basis, of:

| | | | |
|---|---|---|---|
| C: | 0.03–0.15%, | Si: | at most 0.7%, |
| Mn: | 0.1–1.5%, | Ni: | 0.05–1.0%, |
| Cr: | 8–14%, | W: | 0.8–3.5%, |
| V: | 0.1–0.3%, | Nb: | 0.01–0.2%, |
| N: | 0.001–0.1%, | Al: | at most 0.05%, |
| Cu: | 0.4–3.5%, | B: | 0–0.02%, |

one or more elements selected from the group consisting of La, Ce, Ca, Y, Ti, Zr, and Ta: 0–0.2% each, and a balance of Fe and incidental impurities, wherein the Cu and Ni contents satisfy the following Inequality:

$$2.5 \leqq (\%Cu)/(\%Ni) \leqq 4.5.$$

2. The high-Cr ferritic steel of claim 1, which contains B in an amount of 0.0001–0.02%.

3. The high-Cr ferritic steel of claim 1, which contains one or more elements selected from the group consisting of La, Ce, Ca, Y, Ti, Zr, and Ta each in an amount of 0.01–0.2%.

4. The high-Cr ferritic steel of claim 1, which contains B in an amount of 0.0001–0.02% and at least one element selected from the group consisting of La, Ce, Ca, Y, Ti, Zr, and Ta each in an amount of 0.01–0.2%.

5. The high-Cr ferritic steel of claim 1, wherein the content of C is 0.06–0.13%.

6. The high-Cr ferritic steel of claim 1, wherein the content of Si is 0.01–0.2%.

7. The high-Cr ferritic steel of claim 1, wherein the content of Mn is 0.3–1.0%.

8. The high-Cr ferritic steel of claim 1, wherein the content of Ni is 0.01–0.8%.

9. The high-Cr ferritic steel of claim 8, wherein the content of Ni is 0.1–0.6%.

10. The high-Cr ferritic steel of claim 1, wherein the content of Cr is 9–12%.

11. The high-Cr ferritic steel of claim 1, wherein the content of W is 1.5–2.5%.

12. The high-Cr ferritic steel of claim 1, wherein the content of V is 0.15–0.25%.

13. The high-Cr ferritic steel of claim 1, wherein the content of Nb is 0.03–0.1%.

14. The high-Cr ferritic steel of claim 1, wherein the content of Al is 0.005–0.025%.

15. The high-Cr ferritic steel of claim 1, wherein the content of N is 0.02–0.07%.

16. The high-Cr ferrite steel of claim 1, wherein the content of Cu is 0.7–2.0%.

17. The high-Cr ferritic steel of claim 1, wherein the ratio of (%Cu)/(%Ni) is between 3 and 4.

18. The high-Cr ferritic steel of claim 2, wherein B is present in an amount of 0.001–0.005%.

19. The high-Cr ferritic steel of claim 3, wherein each of said one or more elements is present in an amount of 0.02–0.15%.

20. The high-Cr ferritic steel of claim 4, wherein B is present in an amount of 0.001–0.005% and each of said one or more elements is present in an amount of 0.02–0.15%.

21. The high-Cr ferritic steel of claim 1, wherein the steel is subjected to normalizing in the temperature range of 1000°1200° C. followed by tempering in the temperature range of 750°–830° C.

22. The high-Cr ferritic steel of claim 21, wherein the normalizing is performed in the temperature range of 1030°–1100° C. and the temperature at which the subsequent tempering is performed does not exceed the $Ac_1$ point of the steel.

23. The high-Cr ferritic steel of claim 1, wherein the steel is subjected to annealing in the temperature range of 1000°–1200° C.

24. The high-Cr ferritic steel of claim 23, wherein the annealing is performed in the temperature range of 1030°–1100° C.

25. A high-Cr ferritic, heat-resistant steel having improved resistance to copper checking which consists essentially, on a weight basis, of:

| | |
|---|---|
| C: 0.03–0.15%, | Si: at most 0.7%, |
| Mn: 0.1–1.5%, | Ni: 0.05–1.0%, |
| Cr: 8–14%, | W: 0.8–3.5%, |
| V: 0.1–0.3%, | Nb: 0.01–0.2%, |
| N: 0.001–0.1%, | Al: at most 0.05%, |
| Cu: 0.4–3.5%, and | |

a balance of Fe and incidental impurities, wherein the Cu and Ni contents satisfy the following Inequality:

$$2.5 \leqq (\%Cu)/(\%Ni) \leqq 4.5.$$

26. A high-Cr ferritic, heat-resistant steel having improved resistance to copper checking which consists essentially, on a weight basis, of:

| | |
|---|---|
| C: 0.03–0.15%, | Si: at most 0.7%, |
| Mn: 0.1–1.5%, | Ni: 0.05–1.0%, |
| Cr: 8–14%, | W: 0.8–3.5%, |
| V: 0.1–0.3%, | Nb: 0.01–0.2%, |
| N: 0.001–0.1%, | Al: at most 0.05%, |
| Cu: 0.4–3.5%, | B: 0.0001–0.02%, and |

a balance of Fe and incidental impurities, wherein the Cu and Ni contents satisfy the following Inequality:

$$2.5 \leqq (\%Cu)/(\%Ni) \leqq 4.5.$$

27. A high-Cr ferritic, heat resistant steel having improved resistance to copper checking which consists essentially, on a weight basis, of:

| | | | |
|---|---|---|---|
| C: | 0.03–0.15%, | Si: | at most 0.7%, |
| Mn: | 0.1–1.5%, | Ni: | 0.05–1.0%, |
| Cr: | 8–14%, | W: | 0.8–3.5%, |
| V: | 0.1–0.3%, | Nb: | 0.01–0.2%, |
| N: | 0.001–0.1%, | Al: | at most 0.05%, |
| Cu: | 0.4–3.5%, | | |

one or more elements selected from the group consisting of La, Ce, Ca, Y, Ti, Zr, and Ta: 0.01–0.2% each, and a balance of Fe and incidental impurities, wherein the Cu and Ni contents satisfy the following Inequality:

$$2.5 \leqq (\%Cu)/(\%Ni) \leqq 4.5.$$

28. A high-Cr ferritic, heat-resistant steel having improved resistance to copper checking which consists essentially, on a weight basis, of:

| | |
|---|---|
| C: 0.03–0.15%, | Si: at most 0.7%, |
| Mn: 0.1–1.5%, | Ni: 0.05–1.0%, |
| Cr: 8–14%, | W: 0.8–3.5%, |
| V: 0.1–0.3%, | Nb: 0.01–0.2%, |
| N: 0.001–0.1%, | Al: at most 0.05%, |
| Cu: 0.4–3.5%, | B: 0.0001–0.02%, |

one or more elements selected from the group consisting of La, Ce, Ca, Y, Ti, Zr, and Ta: 0.01–0.2% each, and a balance of Fe and incidental impurities, wherein the Cu and Ni contents satisfy the following Inequality:

$$2.5 \leqq (\%Cu)/(\%Ni) \leqq 4.5.$$

29. The high-Cr ferritic steel of claim 1, wherein the steel is essentially Mg-free.

30. The high-Cr ferritic steel of claim 25, wherein the steel is essentially Mg-free.

31. The high-Cr ferritic steel of claim 26, wherein the steel is essentially Mg-free.

32. The high-Cr ferritic steel of claim 27, wherein the steel is essentially Mg-free.

33. The high-Cr ferritic steel of claim 28, wherein the steel is essentially Mg-free.

34. The high-Cr ferritic steel of claim 1, wherein the steel is essentially Mo-free.

35. The high-Cr ferritic steel of claim 25, wherein the steel is essentially Mo-free.

36. The high-Cr ferritic steel of claim 26, wherein the steel is essentially Mo-free.

37. The high-Cr ferritic steel of claim 27, wherein the steel is essentially Mo-free.

38. The high-Cr ferritic steel of claim 28, wherein the steel is essentially Mo-free.

* * * * *

UNITED STATES PATENT AND TRADEMARK OFFICE

CERTIFICATE OF CORRECTION

PATENT NO. : 5,240,516

DATED : August 31, 1993

INVENTOR(S) : Atsuro ISEDA et al

It is certified that error appears in the above-indentified patent and that said Letters Patent is hereby corrected as shown below:

In Item [75], delete "Mausyama" and insert -- Masuyama --.

Signed and Sealed this

First Day of March, 1994

Bruce Lehman

*Attest:*

BRUCE LEHMAN

*Attesting Officer*

*Commissioner of Patents and Trademarks*